US006947823B2

(12) United States Patent
Hasler et al.

(10) Patent No.: US 6,947,823 B2
(45) Date of Patent: Sep. 20, 2005

(54) AIR/FUEL RATIO CONTROL USING A DISPLAY INTERFACE

(75) Inventors: Greg Hasler, Pekin, IL (US); Dave Zwetz, Washington, IL (US)

(73) Assignee: Caterpillar Inc, Peoria, IL (US)

( * ) Notice: Subject to any disclaimer, the term of this patent is extended or adjusted under 35 U.S.C. 154(b) by 67 days.

(21) Appl. No.: 10/308,838

(22) Filed: Dec. 3, 2002

(65) Prior Publication Data

US 2004/0107039 A1 Jun. 3, 2004

(51) Int. Cl.[7] ..... F02D 41/00
(52) U.S. Cl. ..... 701/103
(58) Field of Search ..... 701/103, 115, 701/102; 73/117.3, 116, 23.23, 118.1; 123/480, 486

(56) References Cited

U.S. PATENT DOCUMENTS

| | | | | |
|---|---|---|---|---|
| 4,372,268 A | | 2/1983 | Kolarik | |
| 5,091,858 A | * | 2/1992 | Paielli | 701/115 |
| 5,226,323 A | * | 7/1993 | Wakayama | 73/117.3 |
| 5,293,854 A | | 3/1994 | Tracy et al. | |
| 5,375,577 A | * | 12/1994 | Betts et al. | 123/480 |
| 5,740,771 A | * | 4/1998 | Sebastian | 123/188.4 |
| 5,749,346 A | | 5/1998 | Halvorson et al. | |
| 5,868,116 A | | 2/1999 | Betts et al. | |
| 5,884,210 A | | 3/1999 | Rettig et al. | |
| 6,152,107 A | | 11/2000 | Barnes et al. | |
| 6,269,300 B1 | | 7/2001 | Moore-McKee et al. | |
| 6,349,709 B1 | * | 2/2002 | Evert et al. | 123/585 |
| 6,470,732 B1 | * | 10/2002 | Breton | 73/118.1 |
| 6,523,530 B2 | * | 2/2003 | Evert et al. | 123/585 |
| 2001/0056323 A1 | | 12/2001 | Masters et al. | |
| 2002/0032516 A1 | | 3/2002 | Shimada et al. | |

FOREIGN PATENT DOCUMENTS

| | | | | |
|---|---|---|---|---|
| JP | 56-38538 | * | 4/1981 | F02D/33/00 |
| JP | 58-53639 | * | 3/1983 | F02B/77/08 |

* cited by examiner

*Primary Examiner*—Hieu T. Vo
(74) *Attorney, Agent, or Firm*—Liell & McNeil

(57) ABSTRACT

A method and apparatus for controlling an air/fuel ratio of an internal combustion engine having a programmable air/fuel ratio control. The method and apparatus includes pre-programming a coarse air/fuel ratio setting, determining a condition of the air/fuel ratio being at an undesired value, and programming a fine air/fuel ratio setting using a display interface.

20 Claims, 4 Drawing Sheets

AIR/FUEL RATIO CONTROL USING A DISPLAY INTERFACE

TECHNICAL FIELD

This invention relates generally to a method and apparatus for providing control of an air/fuel ratio for an engine and, more particularly, to a method and apparatus for providing operator control of an air/fuel ratio by way of a display interface.

BACKGROUND

Internal combustion engines are typically tuned to operate under a variety of conditions. Factors such as engine performance and emissions control cannot always be set up for simultaneous optimal specifications, especially in light of the different conditions under which the engine must perform. For example, reducing undesired emissions usually requires sacrificing some degree of engine performance.

One of the factors to consider in engine operating setup is the emission of acceleration smoke, i.e., unburned fuel being exhausted during acceleration caused by a lag in air intake resulting in a rich fuel mixture for a brief period of time. Although the air/fuel ratio may be properly tuned during normal operations, the ratio momentarily becomes excessively rich during acceleration. The excess fuel does not all burn and emits through the exhaust system, thus resulting in a puff of white smoke.

Many attempts have been made to compensate for acceleration smoke. For example, in U.S. Pat. No. 4,372,268, Kolarik describes an apparatus which retards the increase in fuel flow during acceleration to reduce exhaust smoke. The apparatus described by Kolarik, however, is a mechanical structure which cannot be easily modified for varying operating conditions.

The advent of programmable controllers to perform many engine operating functions by the use of software programming has provided the means to be much more flexible in setting up an engine. For example, the amount of air and fuel to be delivered to an engine can be controlled electronically, thus allowing programmable control of the air/fuel ratio. For example, in U.S. Pat. No. 6,269,300, Moore-McKee et al. disclose a method by which software can be produced for engine controllers. Among the many applications of this software, maps can be created which control the air/fuel ratio under different operating conditions. For example, maps of engine speed, boost pressure, and fuel delivery amount can be created to control the air/fuel ratio to some degree.

These maps, however, are designed to accommodate a wide range of engines and operating conditions. Therefore, they must be programmed to a broad degree, i.e., to coarse settings, in order to be applicable to the many engines coming off the assembly line which are destined for many different uses. The coarse settings of the maps, by their very nature, prevent an operator from getting exactly the desired performance being sought from the engine.

The present invention is directed to overcoming one or more of the problems as set forth above.

SUMMARY OF THE INVENTION

In one aspect of the present invention a method for controlling an air/fuel ratio of an internal combustion engine having a programmable air/fuel ratio control is disclosed. The method includes pre-programming a coarse air/fuel ratio setting, determining a condition of the air/fuel ratio being at an undesired value, and programming a fine air/fuel ratio setting using a display interface.

In another aspect of the present invention an apparatus for controlling an air/fuel ratio of an internal combustion engine is disclosed. The apparatus includes a programmable controller electrically connected to the engine, a coarse air/fuel ratio setting programmed into the controller, a display electrically connected to the controller, and an input device interfaced with the display to provide input of a fine air/fuel ratio to the controller.

In yet another aspect of the present invention a display interface for providing control of an air/fuel ratio of an internal combustion engine is disclosed. The display includes a display indication of a range from a maximum to a minimum air/fuel ratio, and an input interface connected to the display for selecting a fine air/fuel ratio from within the range.

In still another aspect of the present invention a method for providing operator control of an air/fuel ratio of an engine having a pre-programmed coarse air/fuel ratio setting is disclosed. The method includes visually monitoring an amount of smoke being emitted from the engine, determining a condition of an undesired value of air/fuel ratio as a function of the monitored smoke, and inputting into a display interface a fine air/fuel ratio setting to adjust the coarse air/fuel ratio setting to a desired value.

In still another aspect of the present invention a method for controlling an air/fuel ratio of an internal combustion engine having a programmable air/fuel ratio control is disclosed. The method includes programming a three-dimensional maximum air/fuel ratio map as a function of engine speed, engine boost pressure, and fuel delivery, programming a three-dimensional minimum air/fuel ratio map as a function of engine speed, engine boost pressure, and fuel delivery, and determining a range from the maximum to the minimum air/fuel ratio maps.

DETAILED DESCRIPTION

Figure 1:
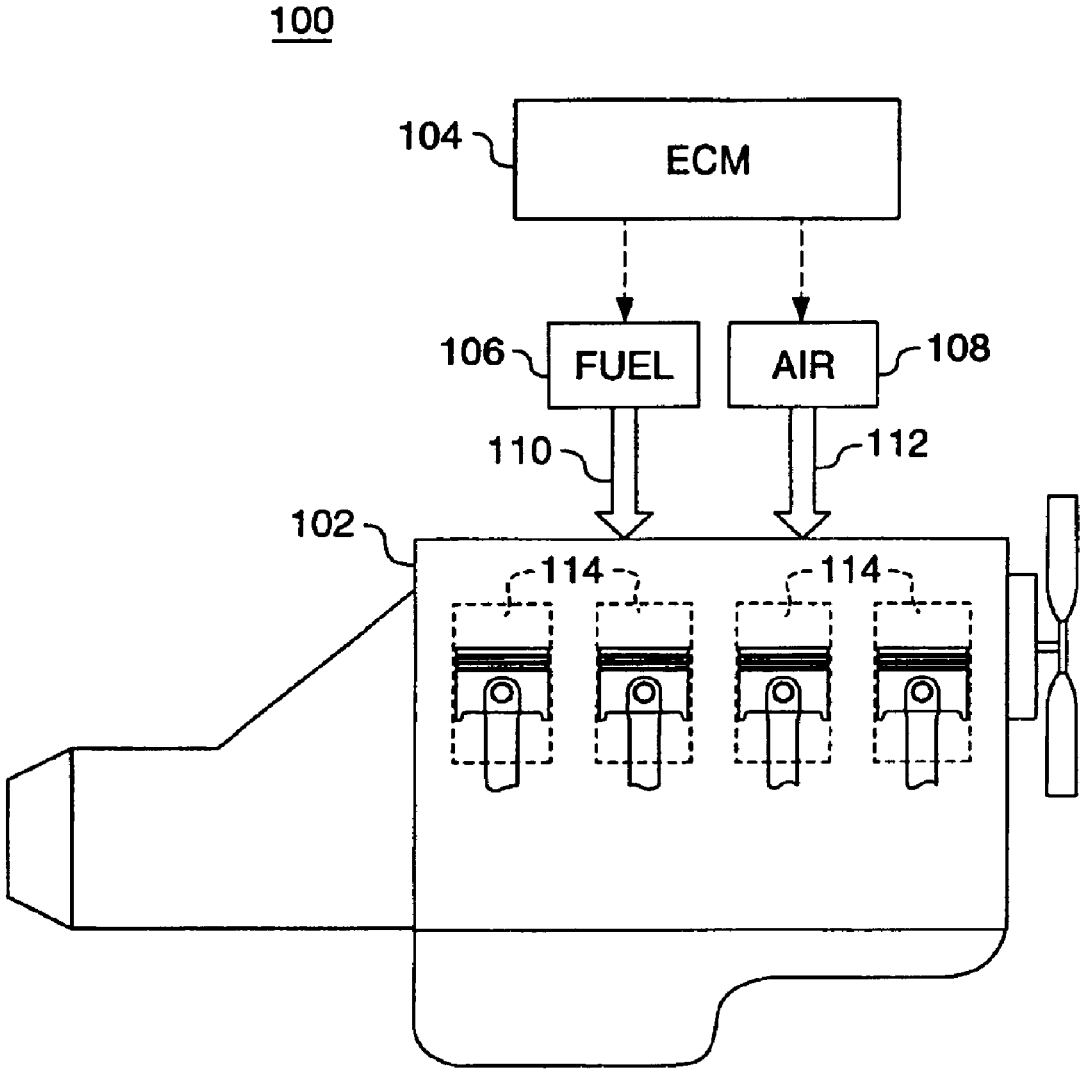
FIG. 1 is a block diagram illustrating an internal combustion engine having programmable air/fuel ratio control.

Referring to the drawings and the appended claims, a method and apparatus 100 for controlling an air/fuel ratio of an internal combustion engine 102 having a programmable air/fuel ratio control is shown.

Referring to FIG. 1, an internal combustion engine 102 receives fuel from a fuel supply 106 by way of a fuel intake path 110. The engine 102 also receives air from an air supply 108 by way of an air intake path 112. The fuel and air are mixed to a predetermined air/fuel ratio either before entry into combustion chambers 114 or within the combustion chambers 114. The engine 102 may be a spark ignition engine, a compression ignition engine, or a combination thereof. The fuel may be any of a variety of types, for example, diesel, gasoline, natural gas, and the like. The fuel may also be a combination of different types of fuels. The air may be pure air from outside the engine 102 or may be mixed with recirculated exhaust gases.

A controller 104, for example, an engine control module (ECM), is electrically connected to the engine 102. The controller 104 is preferably programmable, and controls a number of features and parameters associated with the engine 102. For example, the controller 104 may control the amount and timing of fuel and air allowed into the engine 102, and may also control the ratio in which the fuel and air are mixed, i.e., the fuel/air ratio.

Figure 2:
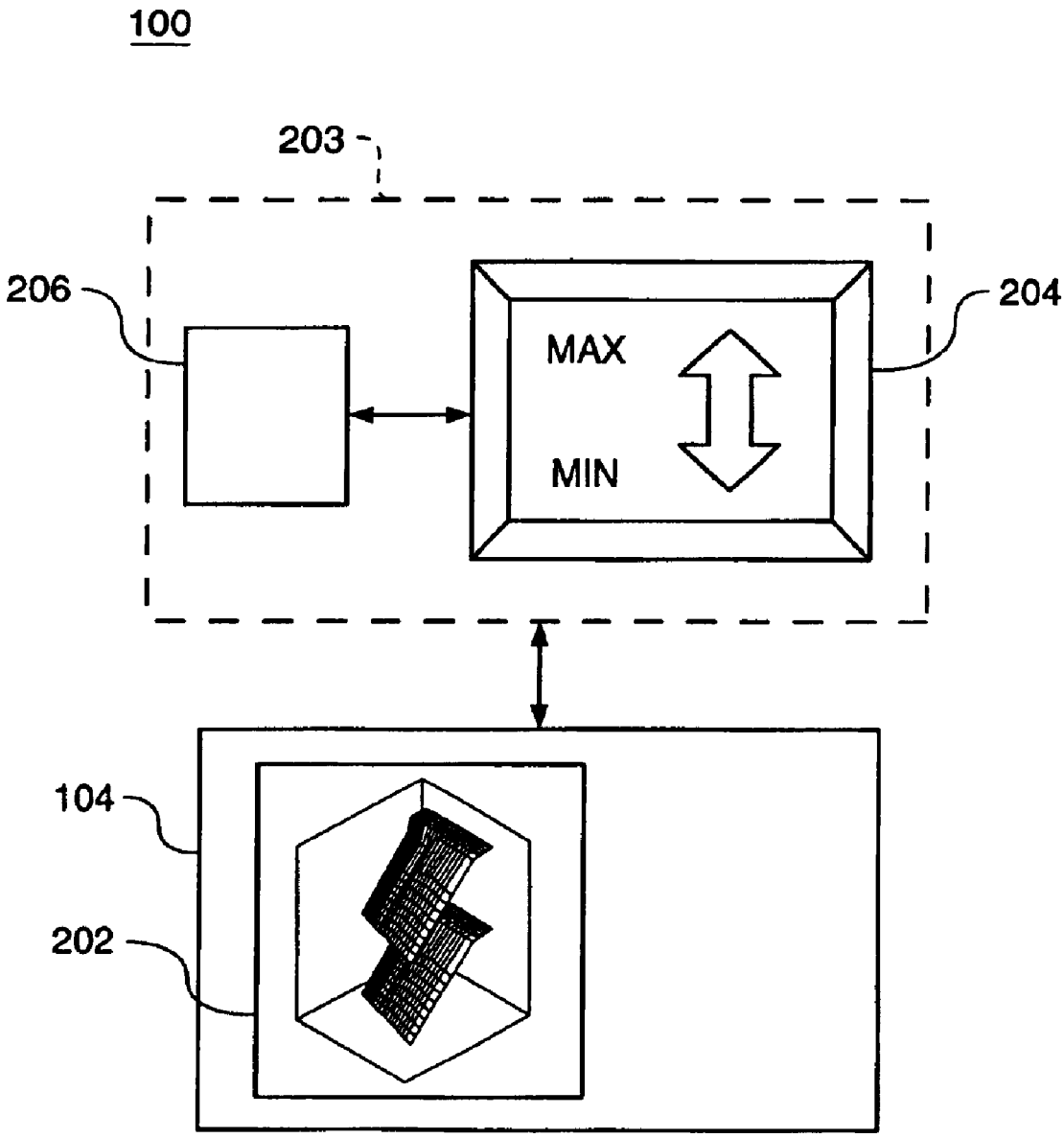
FIG. 2 is a block diagram illustrating a preferred embodiment of the present invention.

Referring to FIG. 2, the controller 104 includes a coarse air/fuel ratio setting 202, preferably software programming stored in memory. The coarse air/fuel ratio setting 202 may be pre-programmed into the controller 104. For example, the coarse air/fuel ratio setting 202 may be pre-programmed based on the expected use of the controller 104 with a particular engine 102 for a particular type of use. The coarse air/fuel ratio setting 202 is described in more detail below with reference to FIG. 3.

Still referring to FIG. 2, a display interface 203 is electrically connected to the controller 104 to deliver and receive information between the display interface 203 and the controller 104. The display interface 203 includes a display 204 and an input device 206. The display 204 may be graphical, such as a graphical LCD display. The input device 206 may be any type of device suited to allow an operator of the engine 102 to input information, such as commands. The input device 206 may be a keypad, slider switch, press buttons, and the like. The input device 206 may be a separate unit from the display 204 or may be incorporated as part of the display 204, for example, a touch screen device.

The display interface 203 may be used for a variety of purposes in addition to monitoring and setting an air/fuel ratio. For example, the display interface 203 may be used to adjust a limit for coolant temperature of the engine 102. The display interface 203 may also be used to indicate a number of warning parameters associated with the engine 102.

Figure 3:
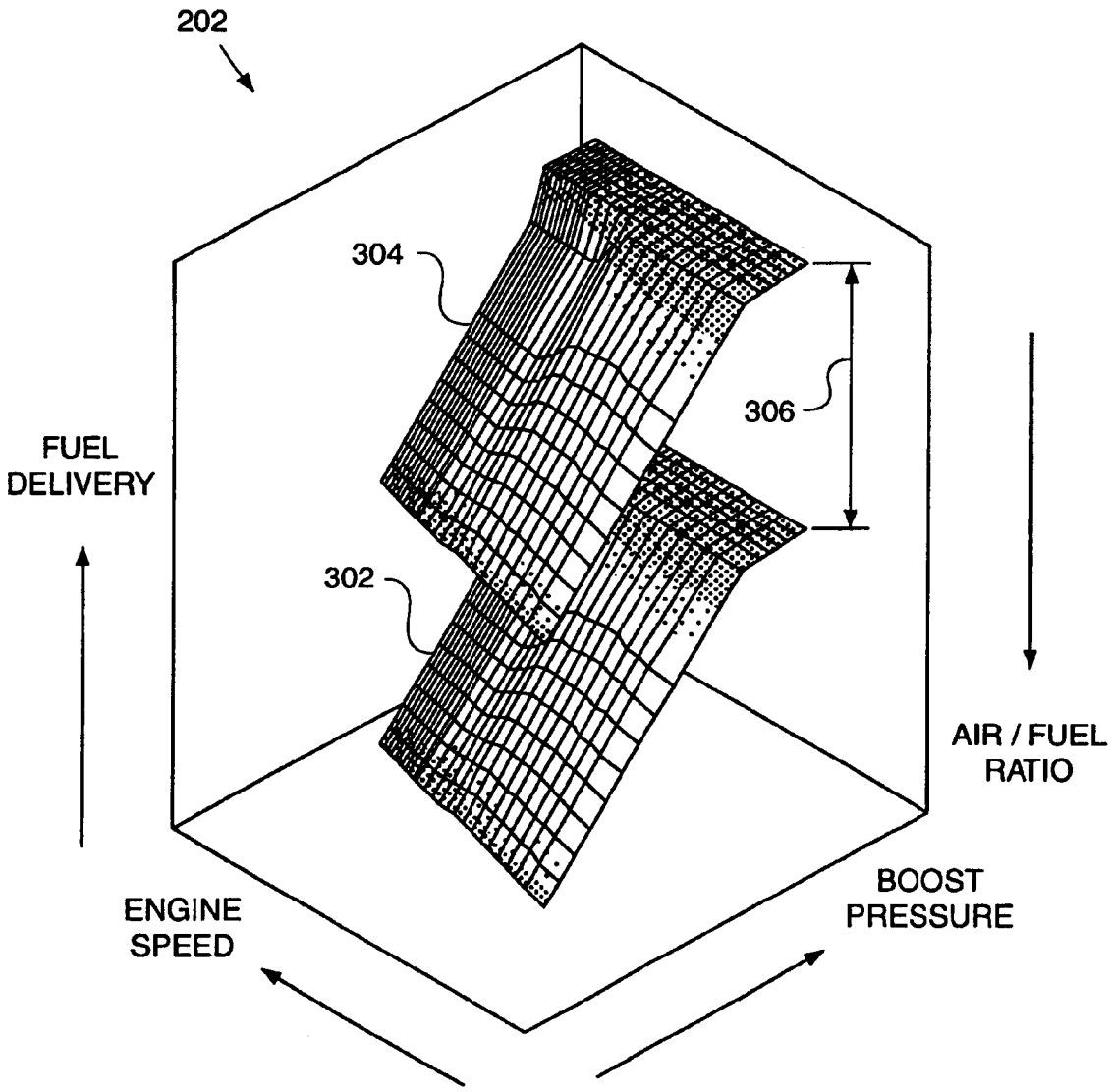
FIG. 3 is a three-dimensional map of a programmed maximum and minimum air/fuel ratio.

Referring now to FIG. 3, the coarse air/fuel ratio setting 202 is depicted as three-dimensional maps. More specifically, a maximum air/fuel ratio map 302 is shown, and a minimum air/fuel ratio map 304 is shown. The maximum air/fuel ratio map 302 corresponds to a lean air/fuel ratio, i.e., the amount of fuel is minimum. The minimum air/fuel ratio map 304 corresponds to a rich air/fuel ratio, i.e., the amount of fuel is maximum.

The three-dimensional maps are shown as a function of engine speed, engine boost pressure, and fuel delivery. However, other functions may be used as well. For example, the maps may be a function of engine speed, boost pressure, and air/fuel ratio.

In the preferred embodiment, for a given engine speed and boost pressure, the fuel delivery may be varied to program a fine setting for the air/fuel ratio. For example, at an engine speed of 1500 rpm and a boost pressure of 150 kPa, the fuel delivery range may be from 8 mm to 10 mm. Choosing a value of 9 mm would correspond to a 50% setting for the air/fuel ratio.

A range 306 from the maximum air/fuel ratio map 302 to the minimum air/fuel ratio map 304 indicates the range of selection an operator has in choosing an air/fuel ratio. The maximum and minimum maps 302,304 represent a coarse air/fuel ratio setting and the range 306 is indicative of a fine air/fuel ratio setting.

INDUSTRIAL APPLICABILITY

Figure 4:
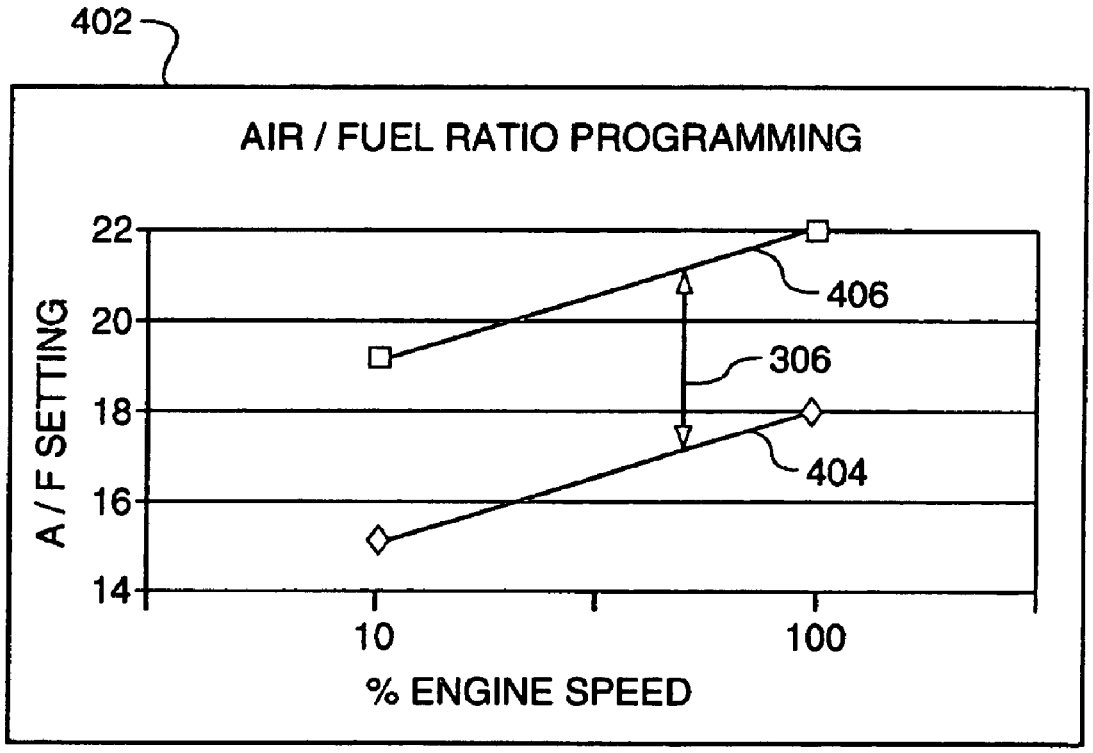
FIG. 4 is a graph illustrating a preferred aspect of the present invention.

Referring to FIG. 4 and with continued reference to FIGS. 1–3, operation of the present invention is described.

FIG. 4 depicts a graph 402 which illustrates the range 306 between the maximum and minimum air/fuel ratio maps 302,304. A zero setting curve 404 represents the minimum air/fuel ratio map 304, i.e., the air/fuel ratio is set to a maximum allowed fuel setting. More specifically, the zero setting curve 404 represents the richest air/fuel ratio allowed, and thus acceleration smoke is maximum.

A 100 setting curve 406 represents the maximum air/fuel ratio map 302, i.e., the air/fuel ratio is set to a minimum allowed fuel setting. More specifically, the 100 setting curve 406 represents the leanest air/fuel ratio allowed, and thus acceleration smoke is minimum. However, the trade-off is that acceleration performance is reduced.

The range 306 from the maximum to minimum air/fuel ratio maps 302,304 extends from the zero setting curve 404 to the 100 setting curve 406. This range 306 is operator selectable to program a fine air/fuel ratio setting from zero, the preferred default value, to 100.

In operation, an operator of the engine 102, for example, an engine used to provide power to a marine craft, visually monitors an amount of acceleration smoke being emitted from the engine 102. If the smoke is objectionable, the operator may adjust the fine air/fuel ratio setting from the default zero value to any value between zero and 100. Preferably, the display interface 203 provides an input device 206, such as an up-down selector, and a display 204 which indicates the setting. The operator chooses a fine air/fuel ratio setting which reduces the amount of acceleration smoke and still provides acceptable acceleration performance.

Other aspects can be obtained from a study of the drawings, the disclosure, and the appended claims.

What is claimed is:

1. An apparatus for controlling an air/fuel ratio of an internal combustion engine, comprising:

a programmable controller electrically connected to the engine;

coarse air/fuel ratio settings which are based at least in part on engine speed, programmed into the controller;

a display electrically connected to the controller; and an input device interfaced with the display to provide input of a fine air/fuel ratio to the controller.

2. An apparatus, as set forth in claim 1, wherein the coarse air/fuel ratio setting includes:

a maximum air/fuel ratio map programmed into the controller; and a minimum air/fuel ratio map programmed into the controller.

3. An apparatus, as set forth in claim 2, wherein the display is a display of a range from the maximum to the minimum air/fuel ratio maps.

4. An apparatus, as set forth in claim 3, wherein the input device is configured to select a fine air/fuel ratio within the range from the maximum to the minimum air/fuel ratio maps.

5. The apparatus of claim 1 wherein the display includes an electronic display to an operator of an available air/fuel ratio range.

6. A display interface for providing control of an air/fuel ratio of an internal combustion engine, comprising:

a display indication of a range from a maximum to a minimum air/fuel ratio; and an input interface connected to the display for selecting a fine air/fuel ratio from within the range.

7. A display interface, as set forth in claim 6, wherein the display indication includes a graphical indication of the range from the maximum to the minimum air/fuel ratio.

8. A display interface, as set forth in claim 7, wherein the input interface includes an up/down selection to select the fine air/fuel ratio.

9. A method for providing operator control of an air/fuel ratio of an engine having a pre-programmed coarse air/fuel ratio setting, including the steps of:

visually monitoring an amount of smoke being emitted from the engine;

determining a condition of an undesired value of air/fuel ratio as a function of the monitored smoke;

displaying to an operator an available air/fuel ratio range of selection; and inputting into a display interface a fine air/fuel ratio setting to adjust the air/fuel ratio to a desired value.

10. A method for controlling an air/fuel ratio of an internal combustion engine having a programmable air/fuel ratio control, including the steps of:

programming a three-dimensional maximum air/fuel ratio map as a function of engine speed, engine boost pressure, and fuel delivery;

programming a three-dimensional minimum air/fuel ratio map as a function of engine speed, engine boost pressure, and fuel delivery; and determining a range from the maximum to the minimum air/fuel ratio maps.

11. A method, as set forth in claim 10, further including the step of selecting a value of fuel delivery within the range for fixed values of engine speed and engine boost pressure.

12. The method of claim 10 further comprising the step of displaying to an operator an available air/fuel ratio range of selection.

13. A method for controlling an air/fuel ratio of an internal combustion engine having a programmable air/fuel ratio control, including the steps of:

pre-programming coarse air/fuel ratio settings which are based at least in part on engine speed;

determining a condition of the air/fuel ratio being at an undesired value; and programming a fine air/fuel ratio setting using a display interface.

14. A method, as set forth in claim 13, wherein determining a condition of the air/fuel ratio being at an undesired value includes the step of monitoring an amount of smoke emitting from the engine.

15. A method, as set forth in claim 14, wherein monitoring an amount of smoke being emitted includes the step of visually monitoring an amount of smoke being emitted.

16. A method, as set forth in claim 13, wherein programming a fine air/fuel ratio setting includes the step of programming an air/fuel ratio setting within a range of pre-programmed air/fuel ratio coarse settings.

17. A method, as set forth in claim 13, wherein programming a fine air/fuel ratio setting includes the step of programming a fine air/fuel ratio setting during normal operation of the engine.

18. A method, as set forth in claim 17, wherein programming a fine air/fuel ratio setting includes the step of programming a fine air/fuel ratio setting by an operator of the engine.

19. A method, as set forth in claim 13, wherein pre-programming a coarse air/fuel setting includes the steps of:

programming a three-dimensional maximum air/fuel ratio map as a function of engine speed, engine boost pressure, and fuel delivery;

programming a three-dimensional minimum air/fuel ratio map as a function of engine speed, engine boost pressure, and fuel delivery; and determining a range from the maximum to the minimum air/fuel ratio maps.

20. The method of claim 13 further comprising the step of displaying to an operator an available air/fuel ratio range of selection.

* * * * *